US012385373B2

(12) United States Patent
Hamzah et al.

(10) Patent No.: US 12,385,373 B2
(45) Date of Patent: Aug. 12, 2025

(54) METHODS AND APPARATUS FOR CREATING AND USING A MULTI-DIMENSIONAL DATA MATRIX TO IDENTIFY AN OPTIMUM ROTARY STEERABLE SYSTEM SETTING

(71) Applicant: Nabors Drilling Technologies USA, Inc., Houston, TX (US)

(72) Inventors: Mohammad Hamzah, Katy, TX (US); Tatiana Borges, Katy, TX (US); Colin Gillan, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 873 days.

(21) Appl. No.: 17/395,037

(22) Filed: Aug. 5, 2021

(65) Prior Publication Data

US 2023/0039266 A1 Feb. 9, 2023

(51) Int. Cl.

| | |
|---|---|
| ***E21B 43/12*** | (2006.01) |
| ***E21B 44/02*** | (2006.01) |
| ***E21B 47/12*** | (2012.01) |
| *E21B 7/04* | (2006.01) |

(52) U.S. Cl.

CPC ..... *E21B 43/126* (2013.01); *E21B 44/02* (2013.01); *E21B 47/12* (2013.01); *E21B 7/04* (2013.01)

(58) Field of Classification Search

CPC ..... E21B 43/126; E21B 44/02; E21B 47/12; E21B 7/04

USPC ..... 703/7, 10

See application file for complete search history.

(56) References Cited

U.S. PATENT DOCUMENTS 8,210,283 B1 * 7/2012 Benson ..... E21B 47/10 175/45

2014/0379133 A1 * 12/2014 Toma ..... E21B 44/00 700/275

* cited by examiner

*Primary Examiner* — John E Johansen

(74) *Attorney, Agent, or Firm* — Haynes and Boone, LLP

(57) ABSTRACT

A method that includes an electronic application identifying an ending of a first drilling segment and a simultaneous beginning of a second drilling segment; identifying a data set of the first drilling segment; automatically creating, in response to the identification of the first drilling segment ending, a new row in a database table that stores a data set for each drilling segment, with the new row storing the variable values of the first drilling segment; creating a multi-dimensional data matrix based on the values in the database table; and extracting, from multi-dimensional data matrix, an optimum value of a variable for an upcoming drilling segment. The method may also include determining that a trajectory or location of a rotary steering system is outside of a tolerance window; and the step of extracting the optimum value of the variable is in response to this determination.

14 Claims, 13 Drawing Sheets

| Variable #1 | Variable #2 | Variable #3 | Relationship Interpretation |
|---|---|---|---|
| Steering Ratio | Steering Ratio Distance | Dog Leg Severity | RSS Response to Steering Modes |

350

| Measurement | Description |
|---|---|
| Steering Ratio or Proportion | The proportion, in a percentage, of the RSS in steering mode |
| Tool Face | The direction of the RSS is steering (i.e., 0 to 360 degrees) |
| Tool Mode | The RSS tool mode |
| Tool Face Mode | The different tool face mode whether referencing to high side/low side or azimuth direction (GTF/MTF) |
| Desired RSS Tool Face | The desired toolface command sent from the rotary steerable operator |
| RSS Pad Pressure | The measured pad pressure being applied by the rotary steerable system during steering mode |

FIG. 4

355

| Measurement | Description |
|---|---|
| Survey MD, Inclination and Azimuth | The surveys taken by the MWD system |

FIG. 5

360

| Measurement | Description |
|---|---|
| Downhole Weight on Bit | The measured weight on bit from the downhole tool |
| Flow Rate | The mud pumps flow rate |
| Weight on Bit | The weight that is applied on the bit |
| Top Drive RPM | The measured rotary speed on the top drive |
| Mechanical Specific Energy | The method to measure drilling efficiency |
| Formation Strength | The calculated formation strength inferred from downhole measurements (acoustic measurement) or apparent formation strength from weight on bit and torque |

FIG. 6

365

| SOURCE | MEASUREMENT | DESCRIPTION |
|---|---|---|
| ROTARY STEERABLE SYSTEM | STICKSLIP SEVERITY | THE RATIO OF THE INTERVAL THE COLLAR IS AT A COMPLETE STOP TO CONTINUE TO ROTATE |
| ROTARY STEERABLE SYSTEM | BIT/BHA WHIRL | THE FREQUENCY OF THE TOOL WHIRLING AROUND THE BOREHOLE AND NOT ROTATING AT THE CENTER OF THE BOREHOLE |
| ROTARY STEERABLE SYSTEM | STEERING RATIO OR PROPORTION | THE PROPORTION IN PERCENTAGE OF THE ROTARY STEERABLE SYSTEM IN STEERING MODE |
| ROTARY STEERABLE SYSTEM | TOOL FACE | THE DIRECTION OF THE ROTARY STEERABLE SYSTEM IS STEERING (0 TO 360 DEGREES) |
| TRAJECTORY CALCULATION | DOG LEG SEVERITY | THE CALCULATED VALUE IN DEG/100 BETWEEN TWO SURVEY POINTS |
| SURFACE CALCULATION | STEERING RATIO DISTANCE | THE DRILLED DISTANCE ASSOCIATED WITH A SPECIFIC ROTARY STEERABLE SYSTEM STEERING RATIO OR PROPORTION |
| ROTARY STEERABLE SYSTEM | TOOL MODE | THE ROTARY STEERABLE SYSTEM TOOL MODE |
| RIG CONTROL SYSTEM | START DEPTH AND END DEPTH | THE START DEPTH AND DEPTH DEPTH OF A SPECIFIC SETTING APPLIED TO THE ROTARY STEERABLE SYSTEM |
| DOWNHOLE MWD SYSTEM | SURVEY MD, INCLINATION AND AZIMUTH | THE SURVEYS TAKEN BY THE MWD SYSTEM |
| DOWNHOLE MWD SYSTEM | CONTINUOUS INCLINATION AND CONTINUOUS AZIMUTH | THE REAL-TIME INCLINATION AND AZIMUTH MEASURED BY THE MWD SYSTEM WHILE DRILLING, TRIPPING |
| RIG CONTROL SYSTEM | FLOW RATE | THE MUD PUMPS FLOW RATE |
| RIG CONTROL SYSTEM | PUMP PRESSURE | THE PRESSURE DROP ACROSS THE DRILLING CIRCULATION SYSTEM FROM SURFACE TO THE BIT |
| RIG CONTROL SYSTEM | WEIGHT ON BIT | THE WEIGHT THAT IS APPLIED ON THE BIT |
| RIG CONTROL SYSTEM | TOP DRIVE TORQUE | THE MEASURED TORQUE ON THE TOP DRIVE |

FIG. 7A

365

| SOURCE | MEASUREMENT | DESCRIPTION |
|---|---|---|
| DOWNHOLE SYSTEM | DOWNHOLE WEIGHT ON BIT | THE MEASURED WEIGHT ON BIT FROM THE DOWNHOLE TOOL |
| DOWNHOLE SYSTEM | DOWNHOLE TORQUE | THE MEASURED TORQUE FROM THE DOWNHOLE TOOL |
| RIG CONTROL SYSTEM | TOP DRIVE RPM | THE MEASURED ROTARY SPEED ON THE TOP DRIVE |
| SURFACE CALCULATION | RATE OF PENETRATION (ROP) | THE CALCULATED RATE OF PENETRATION IN FT/HR OR M/HR |
| SURFACE CALCULATION | BOREHOLE LOCAL TORTUOSITY | THE LOCAL TORTUOSITY CALCULATED FROM SURVEYS |
| SURFACE CALCULATION | BOREHOLE CUMULATIVE TORTUOSITY | THE CUMULATIVE TORTUOSITY CALCULATED FROM SURVEYS |
| ROTARY STEERABLE SYSTEM | TOOL FACE MODE | THE DIFFERENT TOOL FACE MODE WHETHER REFERENCING TO HIGH SIDE/LOW SIDE OR AZIMUTH DIRECTION |
| SURFACE CALCULATION/ DOWNHOLE SYSTEM | FORMATION STRENGTH | THE CALCULATED FORMATION STRENGTH INFERED FROM DOWNHOLE MEASUREMENTS (ACCOUSTIC MEASUREMENT) OR APPARENT FORMATION STRENGTH FROM WEIGHT ON BIT AND TORQUE |
| SURFACE CALCULATION | MECHANICAL SPECIFIC ENERGY | THE METHOD TO MEASURE DRILLING EFFICIENCY |
| ROTARY STEERABLE SYSTEM | ACTUAL RSS TOOL FACE | THE ACTUAL TOOLFACE BEING MEASURED BY THE ROTARY STEERABLE SYSTEM |
| ROTARY STEERABLE SYSTEM | DESIRED RSS TOOL FACE | THE DESIRED TOOLFACE COMMAND SENT FROM THE ROTARY STEERABLE OPERATOR |
| ROTARY STEERABLE SYSTEM | RSS PAD PRESSURE | THE MEASURED PAD PRESSURE BEING APPLIED BY THE ROTARY STEERABLE SYSTEM DURING STEERING MODE |
| ROTARY STEERABLE SYSTEM | RSS STABILITY | THE PERCENTAGE THAT THE TOOL IS STABILIZE AND ABLE TO ORIENTATE ITSELF TO THE HIGH SIDE AND TRUE NORTH |
| TRAJECTORY CALCULATION | ROTARY/FORMATION TENDENCIES | THE CALCULATED ROTARY TENDENCY AND FORMATION TENDENCY FROM SURVEYS AND KNOWN ROTARY STEERABLE SYSTEM SETTINGS |

FIG. 7B

370

| DATE | START TIME | END TIME | START DEPTH | END DEPTH | DRILLED DISTANCE | TOOL MODE | TOOL FACE MODE | TF ANGLE | POWER SETTING | CALC ROP | WOB | TORQUE | RPM | PUM |
|---|---|---|---|---|---|---|---|---|---|---|---|---|---|---|
| | 16:23 | 16:24 | 17184.00 | 17185.00 | 1.00 | INCLINATION HOLD | GRAVITY | | 25.0 | 50.00 | 42.0 | 42.0 | 140 | |
| | 11:43 | 11:54 | 13757.00 | 13765.00 | 8.00 | ABSOLUTE COMMAND | GRAVITY | 342 | 100.0 | 44.44 | 25.0 | 20.0 | 160 | |
| | 23:45 | 00:00 | 19587.00 | 19595.00 | 8.00 | INCLINATION HOLD | GRAVITY | | 25.0 | 32.00 | 40.0 | 41.0 | 145 | |
| | 01:40 | 01:45 | 19715.00 | 19723.00 | 8.00 | INCLINATION HOLD | GRAVITY | | 25.0 | 100.00 | 38.0 | 40.0 | 145 | |
| | 21:32 | 21:38 | 21359.00 | 21367.00 | 8.00 | INCLINATION HOLD | GRAVITY | | 37.5 | 80.00 | 45.0 | 50.0 | 125 | |
| | 20:00 | 20:10 | 14231.00 | 14240.00 | 9.00 | ABSOLUTE COMMAND | GRAVITY | 0 | 100.0 | 52.94 | 30.0 | 25.0 | 160 | |
| | 05:23 | 05:35 | 14778.00 | 14788.00 | 10.00 | ABSOLUTE COMMAND | GRAVITY | 12 | 100.0 | 50.00 | 15.0 | 22.0 | 160 | |
| 10-Mar-15 | 19:55 | 20:10 | 13693.00 | 13703.00 | 10.00 | ABSOLUTE COMMAND | GRAVITY | 342 | 75.0 | 40.00 | 28.0 | 25.0 | 80 | |
| | 21:30 | 21:35 | 14308.00 | 14319.00 | 11.00 | ABSOLUTE COMMAND | GRAVITY | 18 | 75.0 | 137.50 | 35.0 | 30.0 | 160 | |
| | 15:57 | 16:07 | 17173.00 | 17184.00 | 11.00 | INCLINATION HOLD | GRAVITY | | 25.0 | 64.71 | 42.0 | 42.0 | 140 | |
| | 23:41 | 00:00 | 14400.00 | 14414.00 | 14.00 | ABSOLUTE COMMAND | GRAVITY | 18 | 75.0 | 43.75 | 25.0 | 30.0 | 160 | |
| | 19:37 | 19:45 | 21218.00 | 21232.00 | 14.00 | INCLINATION HOLD | GRAVITY | | 37.5 | 107.69 | 50.0 | 49.0 | 125 | |
| | 11:38 | 11:48 | 18687.00 | 18702.00 | 15.00 | INCLINATION HOLD | GRAVITY | | 12.5 | 88.24 | 35.0 | 41.0 | 145 | |
| | 17:23 | 17:36 | 15538.00 | 15554.00 | 16.00 | ABSOLUTE COMMAND | GRAVITY | 90 | 75.0 | 72.73 | 35.0 | 37.0 | 160 | |
| | 04:21 | 04:32 | 19927.00 | 19944.00 | 17.00 | INCLINATION HOLD | GRAVITY | | 25.0 | 94.44 | 40.0 | 40.0 | 145 | |
| 11-Mar-15 | 08:35 | 09:27 | 13703.00 | 13723.00 | 20.00 | ABSOLUTE COMMAND | GRAVITY | 342 | 75.0 | 22.99 | 24.0 | 20.0 | 140 | |
| | 23:34 | 00:00 | 15919.00 | 15941.00 | 22.00 | INCLINATION HOLD | GRAVITY | | | 51.16 | 25.0 | 29.0 | 160 | |
| | 04:35 | 04:48 | 19944.00 | 19967.00 | 23.00 | INCLINATION HOLD | GRAVITY | | 25.0 | 104.55 | 40.0 | 42.0 | 145 | |
| | 00:15 | 00:26 | 21590.00 | 21613.00 | 23.00 | INCLINATION HOLD | GRAVITY | | 25.0 | 127.78 | 48.0 | 50.0 | 125 | |
| | 21:45 | 22:00 | 21367.00 | 21391.00 | 24.00 | INCLINATION HOLD | GRAVITY | | 37.5 | 96.00 | 43.0 | 48.0 | 125 | |
| | 12:50 | 13:10 | 15284.00 | 15309.00 | 25.00 | INCLINATION HOLD | GRAVITY | | | 75.76 | 35.0 | 35.0 | 160 | |
| | 11:04 | 11:18 | 16778.00 | 16804.00 | 26.00 | INCLINATION HOLD | GRAVITY | | 12.5 | 113.04 | 42.0 | 42.0 | 140 | |
| | 08:02 | 08:16 | 20194.00 | 20221.00 | 27.00 | INCLINATION HOLD | GRAVITY | | 25.0 | 117.39 | 42.0 | 48.0 | 125 | |
| | 01:45 | 02:05 | 14526.00 | 14555.00 | 29.00 | ABSOLUTE COMMAND | GRAVITY | 24 | 100.0 | 87.88 | 30.0 | 35.0 | 160 | |
| | 04:00 | 04:20 | 18070.00 | 18100.00 | 30.00 | INCLINATION HOLD | GRAVITY | | 0.0 | 90.91 | 40.0 | 38.0 | 140 | |

FIG. 8

375

| Variable #1 | Variable #2 | Variable #3 | Relationship Interpretation |
|---|---|---|---|
| **Steering Ratio** | Steering Ratio Distance | Dog Leg Severity | RSS response to steering modes |
| **Actual Tool Face** | Desired Tool Face | | RSS tool bias |
| **Formation Strength** | Dog Leg Severity | Expected Dog Leg Severity | Formation tendencies to bias the tool performance |
| **Stickslip Severity** | Steering Ratio | Dog Leg Severity | Effect of stickslip to RSS performance |
| **Weight on Bit** | Pad Force | Dog Leg Severity | Effective side force to RSS steering performance |
| **ROP** | Steering Ratio | Pad Force | Rate of penetration rate effect on RSS steering performance |

FIG. 10

METHODS AND APPARATUS FOR CREATING AND USING A MULTI-DIMENSIONAL DATA MATRIX TO IDENTIFY AN OPTIMUM ROTARY STEERABLE SYSTEM SETTING

FIELD OF THE DISCLOSURE

The disclosure herein relates to a method and apparatus for creating a multi-dimensional data matrix to identify an optimum rotary steerable system setting.

BACKGROUND

During a drilling operation, a directional driller manually identifies the rotary steerable system drilling response. The driller establishes the steering ratio settings on the rotary steerable system ("RSS") together with the optimized surface parameters to steer the well according to a planned trajectory. This information is recorded normally on a slide sheet, which can be referenced by the next directional driller that comes on tour. However, if there is no slide sheet for a specific well, then the directional driller will reference the slide sheet from an offset well to identify optimum RSS settings. The variables that govern the RSS performance, however, are complex and are not limited to steering ratios and surface parameters. This poses a problem to the directional driller. Moreover, the slide sheet does not provide a sufficient record of all relevant conditions, settings, and other variables associated with the drilling operation. As such, reliance on a slide sheet to identify optimum rotary steerable settings is not consistent, increases cost, and reduces the reliability of the drilling operation.

SUMMARY OF THE DISCLOSURE

In some embodiments, the present disclosure includes a method that includes identifying, during a rotary steerable drilling operation, an ending of a first drilling segment and a simultaneous beginning of a second drilling segment that follows directly after the first drilling segment; wherein identifying the ending of the first drilling segment and the simultaneous beginning of the second drilling segment comprises any one or more the following: identifying a change in a rotary steerable setting; initiating a standard survey; and identifying a change in surface or downhole parameters; identifying a data set of the first drilling segment; wherein the data set comprises values of variables; and wherein relationships are identified between variables; accessing a database table that stores a data set for each drilling segment; wherein the database table comprises a plurality of rows; wherein each row stores values of a set of variables; and wherein each row is associated with a single drilling segment; automatically creating, by an electronic application and in response to the identification of the first drilling segment ending, a new row in the database table to store the variable values of the first drilling segment; and identifying, using the database table and the electronic application, an optimum value of a first variable from the set of variables, comprising: identifying a relationship that includes the first variable; wherein the relationship is associated with the first variable and a second variable from the set of variables; creating a multi-dimensional data matrix based on the values of the first variable from the database table and the values of the second variable from the database table; and extracting, from multi-dimensional data matrix, the optimum value of the first variable. In some embodiments, the relationship is further associated with a third variable from the set of variables; and the multi-dimensional data matrix is further based on the values of the third variable from the database table. In some embodiments, the first variable is a steering ratio, the second variable is a steering ratio distance, and the third variable is a dog leg severity. In some embodiments, the first variable is an actual tool face and the second variable is a desired tool face. In some embodiments, the first variable is a formation strength, the second variable is a dog leg severity, and the third variable is an expected dog leg severity. In some embodiments, the relationship is associated a number of variables from the set of variables; and the multi-dimensional data matrix has a number of axes identical to the number of variables associated with the relationship. In some embodiments, the first variable is a rotary steerable setting. In some embodiments, the method also includes the electronic application sending instructions to a surface control system to implement the rotary steerable setting. In some embodiments, the method also includes the surface control system controlling a mud pump system and/or a rotary drive system to change the rotary steerable setting thereby transforming a rotary steering system from a first state to a second state. In some embodiments, the method also includes determining that a trajectory or location of the rotary steering system is outside of a tolerance window; wherein identifying, using the database table and the electronic application, the optimum value of the first variable from the set of variables is in response to the determination that the trajectory or location of the rotary steering system is outside of the tolerance window.

In some embodiments, the present disclosure includes a surface control system of a drilling rig; wherein the surface control system of the drilling rig comprises a mud pump system and/or a rotary drive system; and an electronic application, wherein the electronic application is configured to: identify, during a rotary steerable drilling operation, an ending of a first drilling segment and a simultaneous beginning of a second drilling segment that follows directly after the first drilling segment; wherein identifying the ending of the first drilling segment and the simultaneous beginning of the second drilling segment comprises any one the following: identifying a change in a rotary steerable setting; initiating a standard survey; and identifying a change in surface or downhole parameters; identifying a data set of the first drilling segment; wherein the data set comprises values of variables; and wherein relationships are identified between variables; accessing a database table that stores a data set for each drilling segment; wherein the database table comprises a plurality of rows; wherein each row stores values of a set of variables; and wherein each row is associated with a single drilling segment; automatically creating, in response to the identification of the first drilling segment ending, a new row in the database table to store the variable values of the first drilling segment; and identifying, using the database table, an optimum value of a first variable from the set of variables, comprising: identifying a relationship that includes the first variable; wherein the relationship is associated with the first variable and a second variable from the set of variables; creating a multi-dimensional data matrix based on the values of the first variable from the database table and the values of the second variable from the database table; and extracting, from multi-dimensional data matrix, the optimum value of the first variable. In some embodiments, the relationship is further associated with a third variable from the set of variables; and the multi-dimensional data matrix is further based on the values of the third variable from the database table. In some embodiments, the first variable is a steering ratio, the second variable is a steering ratio distance, and the third variable is a dog leg severity. In some embodiments, the first variable is an actual tool face and the second variable is a desired tool face. In some embodiments, the first variable is a formation strength, the second variable is a dog leg severity, and the third variable is an expected dog leg severity. In some embodiments, the relationship is associated a number of variables from the set of variables; and the multi-dimensional data matrix has a number of axes identical to the number of variables associated with the relationship. In some embodiments, the first variable is a rotary steerable setting. In some embodiments, the electronic application is further configured to send instructions to a surface control system to implement the rotary steerable setting. In some embodiments, the surface control system is configured to control the mud pump system and/or the rotary drive system to change the rotary steerable setting thereby transforming a rotary steering system from a first state to a second state. In some embodiments, the electronic application is further configured to determine that a trajectory or location of the rotary steering system is outside of a tolerance window; wherein identifying, using the database table and the electronic application, the optimum value of the first variable from the set of variables is in response to the determination that the trajectory or location of the rotary steering system is outside of the tolerance window.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 4-7A and 7B are tables associated with the method of FIG. 3, according to one or more aspects of the present disclosure.

FIG. 8 is table generated during the method of FIG. 3, according to one or more aspects of the present disclosure.

FIG. 10 is a table associated with the method of FIG. 3, according to one or more aspects of the present disclosure.

DETAILED DESCRIPTION

Figure 1:
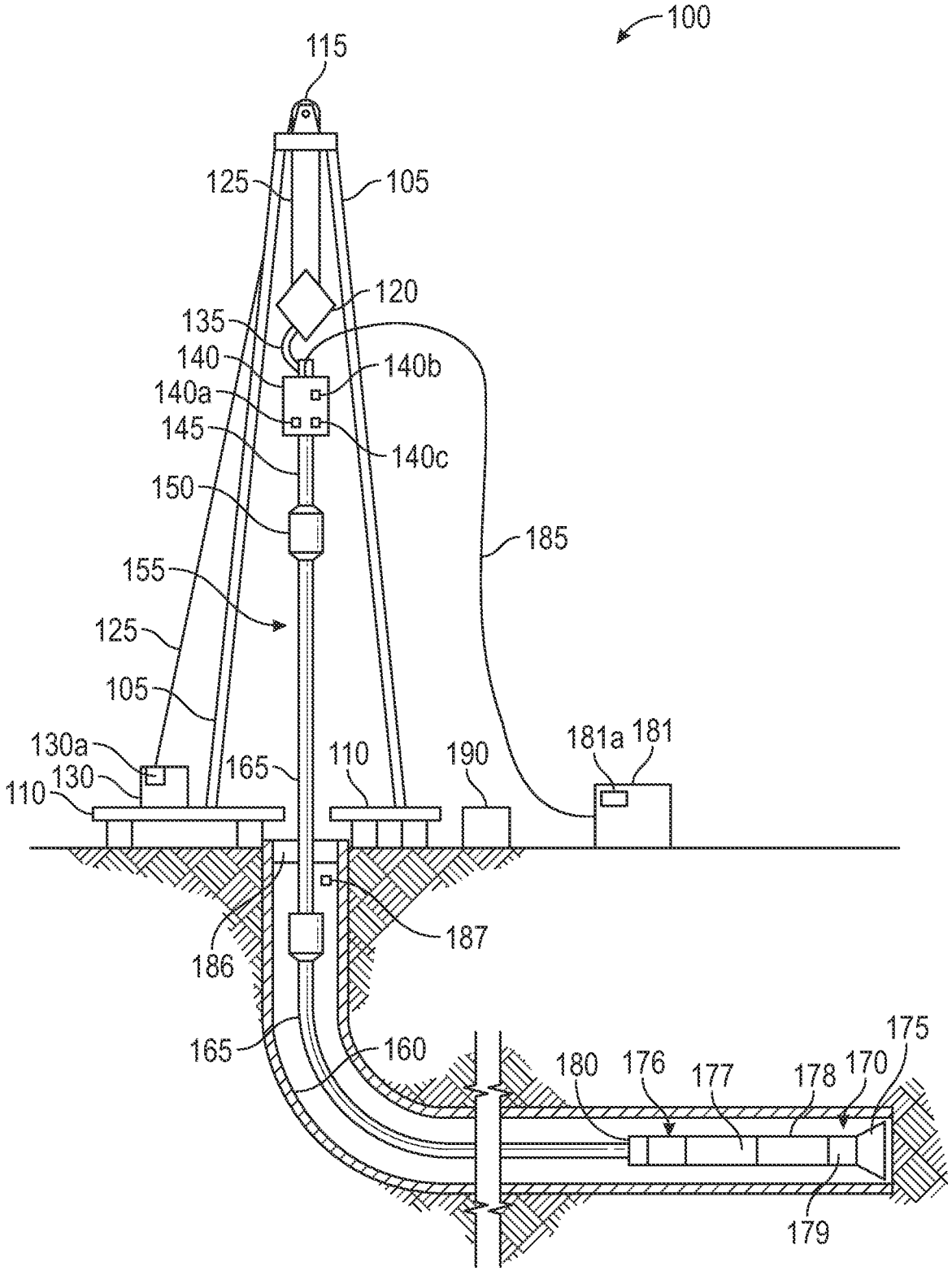
FIG. 1 is a schematic diagram of a drilling rig apparatus according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

The apparatus and method disclosed herein provide improvements to conventional methods of storing and using data sets associated with drilling segments. The apparatus and method disclosed herein provide reliable and cost-efficient instructions to automate drilling operations. The apparatus and method disclosed herein automate the creation of instructions that are provided to a drilling rig, with implementation of these instructions resulting in a higher cost efficiency and reliability. In some embodiments, instructions are downlinked to a rotary steerable system ("RSS") using the automated instructions/targets that are created using the multi-dimensional data matrices disclosed herein. The RSS includes some type of steering device, such as extendable and retractable arms that apply lateral forces along a borehole wall to gradually effect a turn. The apparatus and method disclosed herein control the transformation of the steering device from a first state in which the arms are in a first configuration to a second state in which the arms are in a second configuration that is different from the first configuration.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to draw works 130, which is configured to reel out and reel in the drilling line 125 to cause the traveling block 120 to be lowered and raised relative to the rig floor 110. The draw works 130 may include a rate of penetration ("ROP") sensor 130*a*, which is configured for detecting an ROP value or range, and a surface control system to feed-out and/or feed-in of a drilling line 125. The other end of the drilling line 125, known as a dead line anchor, is anchored to a fixed position, possibly near the draw works 130 or elsewhere on the rig.

A hook 135 is attached to the bottom of the traveling block 120. A drive system 140 is suspended from the hook 135. A quill 145, extending from the drive system 140, is attached to a saver sub 150, which is attached to a drill string 155 suspended within a wellbore 160. Alternatively, the quill 145 may be attached to the drill string 155 directly. The term "quill" as used herein is not limited to a component which directly extends from the drive system 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill." In the example embodiment depicted in FIG. 1, the drive system 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may additionally or alternatively include a torque sensor 140*a* coupled to or otherwise associated with the drive system 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The drive system 140 may additionally or alternatively include or otherwise be associated with a speed sensor 140*b* configured to detect a value or range of the rotational speed of the quill 145. The drive system 140, the draw works 130, the crown block 115, the traveling block 120, drilling line or dead line anchor may additionally or alternatively include or otherwise be associated with a WOB or hook load sensor 140*c* (e.g., one or more sensors installed somewhere in the load path mechanisms to detect and calculate WOB, which can vary from rig-to-rig). The WOB sensor 140*c* may be configured to detect a WOB value or range, where such detection may be performed at the drive system 140, the draw works 130, or other component of the apparatus 100. Generally, the hook load sensor 140*c* detects the load on the hook 135 as it suspends the drive system 140 and the drill string 155.

The drill string 155 includes interconnected sections of drill pipe or tubulars 165 and a BHA 170, which includes a drill bit 175. The BHA 170 may include one or more measurement-while-drilling ("MWD") or wireline conveyed instruments 176, flexible connections 177, an RSS 178 that includes adjustment mechanisms 179 for push-the-bit drilling or bent housing and bent subs for point-the-bit drilling, a downhole control system 180, stabilizers, and/or drill collars, among other components. One or more pumps of a mud pump system 181 may deliver drilling fluid to the drill string 155 through a hose or other conduit 185, which may be connected to the drive system 140. In some embodiments, a mud pump sensor 181*a* monitors the output of the mud pump system 181 and may measure the flow rate produced by the mud pump system 181 and/or a pressure produced by the mud pump system 181.

The downhole MWD or wireline conveyed instruments 176 may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, sent to the downhole control system 180, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In some embodiments, the downhole control system 180 is configured to control or assist in the control of one or more components of the apparatus 100. For example, the downhole control system 180 may be configured to transmit operational control signals to the surface control system 190, the draw works 130, the drive system 140, other components of the BHA 170 such as the adjustment mechanism 179, and/or the mud pump system 181. The downhole control system 180 may be a stand-alone component that forms a portion of the BHA 170 or be integrated in the adjustment mechanism 179 or a sensor that forms a portion of the BHA 170. The downhole control system 180 may be configured to transmit the operational control signals or instructions to the draw works 130, the drive system 140, other components of the BHA 170, and/or the mud pump system 181 via wired or wireless transmission means which, for the sake of clarity, are not depicted in FIG. 1.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

Figure 2:
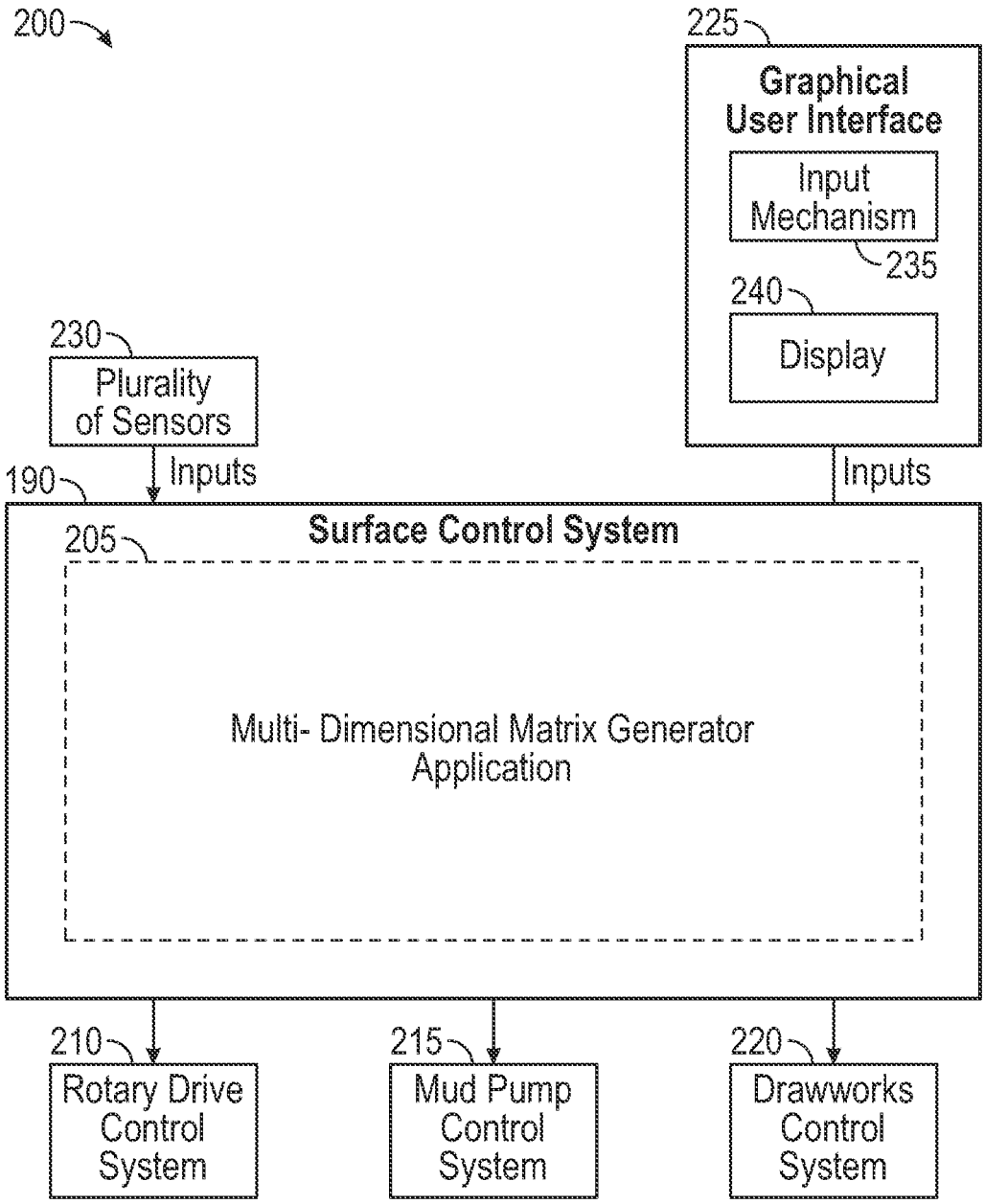
FIG. 2 is a diagrammatic illustration of a data flow involving at least a portion of the drilling rig apparatus of FIG. 1, according to one or more aspects of the present disclosure.

FIG. 2 is a diagrammatic illustration of a data flow 200 involving at least a portion of the apparatus 100 according to one embodiment. Generally, the surface control system 190 is operably coupled to or includes a multi-dimensional matrix generator application 205 that monitors drilling segments, stores data sets associated with each drilling segment, creates multi-dimensional data matrices using the stored data sets, and generates instructions for the surface control surface 190 to implement using the multi-dimensional data matrices. The application 205 sends optimum values of variables, such as rotary steerable setting, to one or more of a drive control system 210, a mud pump control system 215, and a draw works control system 220. The target outputs may be based on a plurality of inputs received via a graphical user interface 225 or via a database lookup.

In some embodiments, the surface control system 190 is, or forms a portion of, a computing system that is configured to control or assist in the control of one or more components of the apparatus 100. For example, the surface control system 190 may be configured to transmit operational control signals to the draw works 130, the drive system 140, the BHA 170 and/or the mud pump system 181. The surface control system 190 may be a stand-alone component installed near the mast 105 and/or other components of the apparatus 100. In an example embodiment, the surface control system 190 includes one or more systems located in a control room proximate the mast 105, such as the general-purpose shelter often referred to as the "doghouse" serving as a combination tool shed, office, communications center, and general meeting place. The surface control system 190 may be configured to transmit the operational control signals to the draw works 130, the drive system 140, the BHA 170, and/or the mud pump system 181 via wired or wireless transmission means.

In some embodiments, the multi-dimensional matrix generator application 205 is an electronic application operably coupled to the drive control system 210, the mud pump control system 215, and the draw works control system 220, and is configured to send signals to each of the control systems 210, 215, and 220 to control the operation of the drive system 140, the mud pump system 181, and the draw works 130. The multi-dimensional matrix generator application 205 may include a variety of sub modules, with each of the sub modules being associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. The multi-dimensional matrix generator application 205 may identify which testing sequence or downlink sequence the surface control system 190 should implement and send optimum output values—based on a selected downlink sequence associated with the optimum value of a rotary steerable setting—to various tools such as the drive control system 210 and/or mud pump control system 215. The multi-dimensional matrix generator application 205 receives data, such as the measured output values, from the plurality of sensors 230. The multi-dimensional matrix generator application 205 may receive the measured output values over a period of time and compare the optimum output values to the measured output values. The multi-dimensional matrix generator application 205 may produce and send the results to the GUI 225. In some embodiments, and as illustrated, the application 205 and the surface control system 190 may be integral components of a single system or surface control system. However, in other embodiments, the application 205 is stored in a component that is physically spaced from the surface control system 190. In this instance, the application 205 may be coupled to or accessed by the surface control system 190 via a wireless network or wired connection.

In some embodiments the rotary drive control system 210 includes the torque sensor 140*a*, the quill position sensor, the hook load sensor 140*c*, the pump pressure sensor, the MSE sensor, and the rotary RPM sensor, and a surface control system and/or other means for controlling the rotational position, speed and direction of the quill or other drill string component coupled to the drive system (such as the quill 145 shown in FIG. 1). The rotary drive control system 210 is configured to receive a rotary drive control signal from the application 205, if not also from other components of the apparatus 100. The rotary drive control signal directs the position (e.g., azimuth), spin direction, spin rate, and/or oscillation of the quill 145. The rotary drive control system 210 is not required to include a top drive, but instead may include other drive systems, such as a power swivel, a rotary table, a coiled tubing unit, a downhole motor, and/or a conventional rotary rig, among others.

In some embodiments, the mud pump control system 215 includes a mud pump surface control system and/or other means for controlling the flow rate and/or pressure of the output of the mud pump system 181 and any associated sensors, such as the sensor 181*a*, for monitoring the output of the mud pump system 181.

In some embodiments, the draw works control system 220 includes the draw works surface control system and/or other means for controlling the feed-out and/or feed-in of the drilling line 125. Such control may include rotational control of the draw works (in v. out) to control the height or position of the hook 135 and may also include control of the rate the hook 135 ascends or descends.

As illustrated, the GUI 225 is operably coupled to or the surface control system 190. The GUI 225 includes an input mechanism 235 for user-inputs. The input mechanism 235 may include a touch-screen, keypad, voice-recognition apparatus, dial, button, switch, slide selector, toggle, joystick, mouse, data base and/or other conventional or future-developed data input device. Such input mechanism 235 may support data input from local and/or remote locations. Alternatively, or additionally, the input mechanism 235 may include means for user-selection of input parameters, such as via one or more drop-down menus, input windows, etc. In general, the input mechanism 235 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 225 may also include a display 240 for visually presenting information to the user in textual, graphic, or video form. The display 240 may also be utilized by the user to input the input parameters in conjunction with the input mechanism 235. For example, the input mechanism 235 may be integral to or otherwise communicably coupled with the display 240. Depending on the implementation, the display 240 may include, for example, an LED or LCD display computer monitor, touchscreen display, television display, a projector, or other display device. The GUI 225 and the surface control system 190 may be discrete components that are interconnected via wired or wireless means. Alternatively, the GUI 225 and the surface control system 190 may be integral components of a single system or surface control system.

A plurality of sensors 230 provide inputs or data to the surface control system 190 via wired or wireless transmission means. The plurality of sensors 230 may include the ROP sensor 130*a*; the torque sensor 140*a*; the quill speed sensor 140*b*; the hook load sensor 140*c*; the mud pump sensor 181*a*; the surface casing annular pressure sensor 187; a downhole annular pressure sensor; a shock/vibration sensor that is configured for detecting shock and/or vibration in the BHA 170; a toolface sensor configured to estimate or detect the current toolface orientation or toolface angle; a MWD WOB sensor configured to detect WOB at or near the BHA 170; a bit torque sensor that generates data indicative of the torque applied to the bit 175; the hook position sensor; a rotary RPM sensor; a quill position sensor; a pump pressure sensor; a MSE sensor; a bit depth sensor; and any variation thereof. The downhole annular pressure sensor may be configured to detect a pressure value or range in the annulus-shaped region defined between the external surface of the BHA 170 and the internal diameter of the wellbore 160, which may also be referred to as the casing pressure, downhole casing pressure, MWD casing pressure, or downhole annular pressure. These measurements may include both static annular pressure (pumps off) and active annular pressure (pumps on). However, in other embodiments the downhole annular pressure may be calculated using measurements from a plurality of other sensors located downhole or at the surface of the well. The toolface sensor may be or include a conventional or future-developed gravity toolface sensor which detects toolface orientation relative to the Earth's gravitational field. Alternatively, or additionally, the toolface sensor may be or include a conventional or future-developed magnetic toolface sensor which detects toolface orientation relative to magnetic north or true north. In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor may also, or alternatively, be or include a conventional or future-developed gyro sensor.

The plurality of sensors 230 may additionally or alternatively include an inclination sensor integral to the BHA 170 that is configured to detect inclination at or near the BHA 170. The plurality of sensors 230 may additionally or alternatively include an azimuth sensor integral to the BHA 170 that is configured to detect azimuth at or near the BHA 170. In some embodiments, the BHA 170 also includes another directional sensor (e.g., azimuth, inclination, toolface, combination thereof, etc.) that is spaced along the BHA 170 from a first directional sensor (e.g., the inclination sensor, the azimuth sensor). For example, and in some embodiments, the sensor is positioned in the MWD 176 and the first directional sensor is positioned in the adjustment mechanism 179, with a known distance between them, for example 20 feet, configured to estimate or detect the current toolface orientation or toolface angle. The sensors may be spaced along the BHA 170 in a variety of configurations. The data detected by any of the sensors in the plurality of sensors 230 may be sent via electronic signal to the surface control system 190 via wired or wireless transmission.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

Generally, the surface control system 190: monitors, in real-time, tool settings and drilling operations relating to a wellbore; creates and/or modifies drilling instructions based on the monitored drilling operations; monitors the responsiveness of drilling equipment used in the drilling operation; and identifies potential problems with the steering of the RSS by comparing the location or projected location of the BHA 180 to a target well path. As used herein, the term "real-time" is thus meant to encompass close to real-time, such as within about 10 seconds, preferably within about 5 seconds, and more preferably within about 2 seconds. "Real-time" can also encompass an amount of time that provides data based on a wellbore drilled to a given depth to provide actionable data according to the present disclosure before a further wellbore being drilled achieves that depth.

Figure 3:
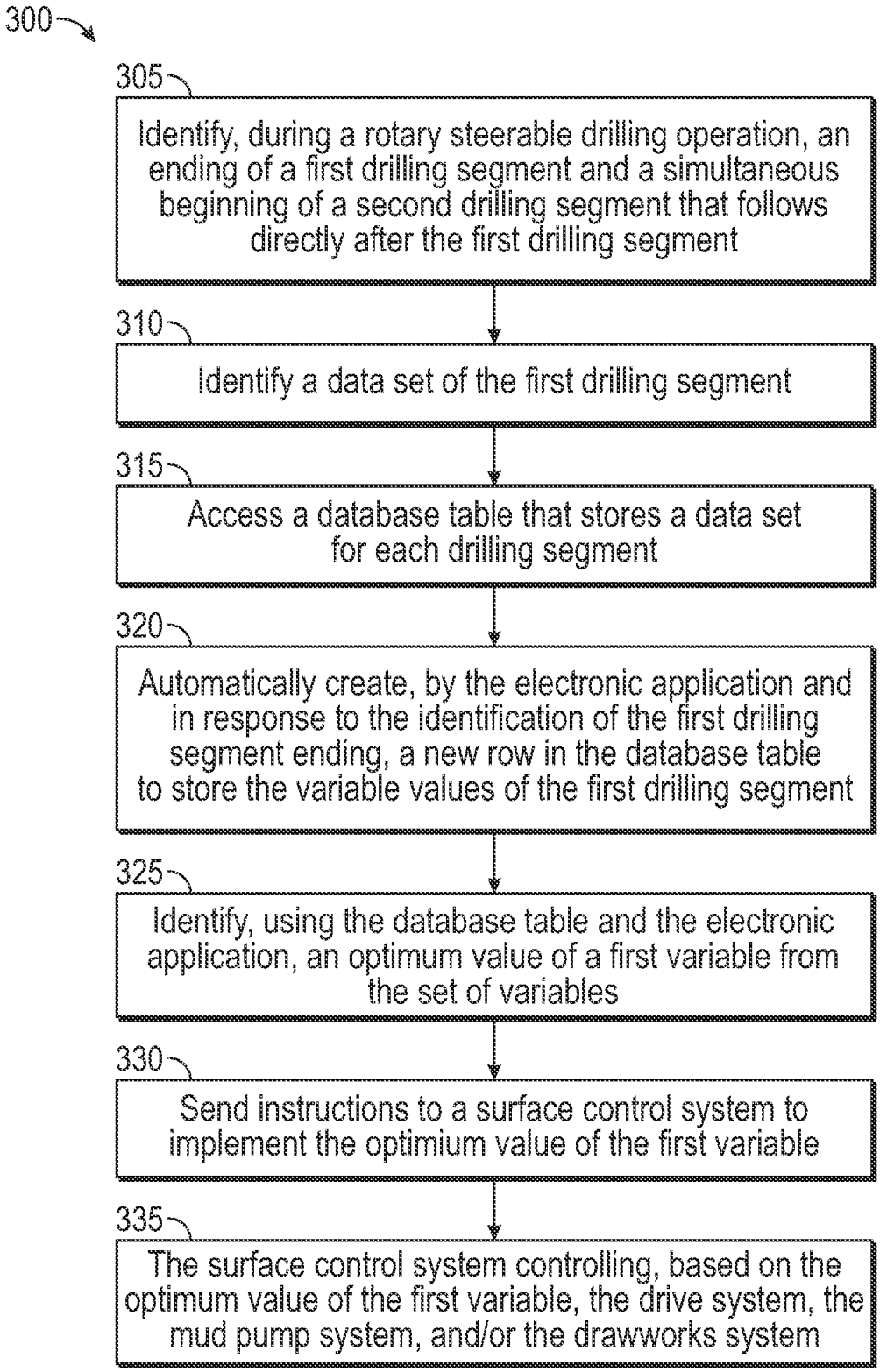
FIG. 3 is a flow chart diagram of a method according to one or more aspects of the present disclosure.

FIG. 3 is a flow chart showing an example method 300 of creating a multi-dimensional matrix and generating instructions based on the multi-dimensional matrix. It is understood that additional steps can be provided before, during, and after the steps of method 300, and that some of the steps described can be replaced or eliminated for other implementations of the method 300. In an example embodiment, the method 300 includes the application 205 identifying, during a rotary steerable drilling operation, the ending of a first drilling segment and the simultaneous beginning of a second drilling segment that follows directly after the first drilling segment at step 305; identifying a data set of the first drilling segment at step 310; accessing a database table that includes a plurality of rows at step 315; creating a new row to store the data set of the first drilling segment at step 320; identifying, using the database, an optimum value of a first variable such as a rotary steerable setting at step 325; sending instructions to a surface control system to implement the optimum value of the first variable at step 330; and the surface control system controlling, based on the optimum value of the first variable, the drive system, the mud pump system, and/or the drawworks system at step 335.

In some embodiments and at the step 305, the application 205 identifies, during the rotary steerable drilling operation, the ending of the first drilling segment and the simultaneous beginning of the second drilling segment that follows directly after the first drilling segment. In some embodiments, a drilling segment is a segment of the wellbore that is drilled under a certain combination of 1) rotary steerable settings and 2) surface and/or downhole parameters. Moreover, a segment generally ends with the initiation of a standard survey. Thus, identifying the ending of a first drilling segment and the simultaneous beginning of the second drilling segment may include any one the following: identifying a change in a rotary steerable setting, initiating a standard survey, and identifying a change in surface or downhole parameters. FIG. 4 illustrates a table 350 of example rotary steerable settings, which when changed, ends the first drilling segment. FIG. 5 illustrates a table 355 of example standard survey measurements, with the initiation of a standard survey ending the first drilling segment. FIG. 6 illustrates a table 360 of example surface and/or downhole parameters, which when changed, ends the first drilling segment. Generally, the application 205 monitors the rotary steerable settings, the surface parameters, and the downhole parameters. In some embodiments, the application 205 monitors downlinking sequences to determine if the rotary steerable settings are to change but can also receive confirmation of the rotary steerable settings via communications received by the surface steerable system and from the BHA 170.

In some embodiments and at step 310, the application 205 identifies a data set of the first drilling segment. In some embodiments, the data set comprises values of variables; with relationships having been identified between the variables. In some embodiments, a data set of a drilling segment includes a start time at which the first drilling segment began; an end time at which the first drilling segment ended; a start depth at which the first drilling segment began; an end depth at which the first drilling set ended; a steering ratio; a steering ratio distance; actual tool face; a target tool face; formation strength; dog leg severity; a pad force; a rate of penetration; a weight on bit; a survey MD, inclination, and azimuth; a continuous inclination and continuous azimuth; a flow rate; a pump pressure; a top drive torque; a downhole weight on bit; a downhole torque; a top drive RPM; a borehole local tortuosity; a borehole cumulative tortuosity; a tool face mode; a mechanical specific energy; an actual RSS tool face; a target RSS tool face; a RSS pad pressure; a RSS stability; and rotary/formation tendencies. Generally, the data set of a drilling segment includes data reported or measured by different sources. In some embodiments, the data in the data set include direct measurements from the plurality of sensors 230, but the data in the data set may also be calculations using a variety of measurements, such as local tortuosity. FIGS. 7A and 7B illustrates a table 365 that includes measurements that may be included in the data set, along with a source and description of each. Generally, the application 205 may be linked, in communication with other steering applications, or form a portion of a steering application such as SMARTNAV™ provided by Nabors Industries of Houston, Texas.

In some embodiments and at the step 315, the application 205 accesses a database table that includes a plurality of rows. FIG. 8 illustrates one example of the database table, identified by numeral 370, accessed during the step 315. As illustrated, the table 370 includes a plurality of rows (with each row associated with a drilling segment) and a plurality of columns (with each column being associated with one type of data from the data sets or associated with one variable). Generally, each row stores values of a set of variables arranged in columns. Each row is associated with a single drilling segment. As illustrated, a header or data identifier is included in one row. In some embodiments, the table 370 is associated with one well, but in other embodiments the table 370 is associated with a grouping of offset wells, or wells within a specific region or area. In some embodiments, the table 370 is associated with one well, but there is table similar to the table 370 for each well in an area or region.

In some embodiments and at the step 320, the application 205 creates a new row to store the data set of the first drilling segment. A new row is automatically stored upon the detection of the ending of the first drilling segment. The steps 305, 310, 315, and 320 are repeated throughout the drilling operation to build the database table 370 and store the values of the variables for each drilling segment.

Figure 9:
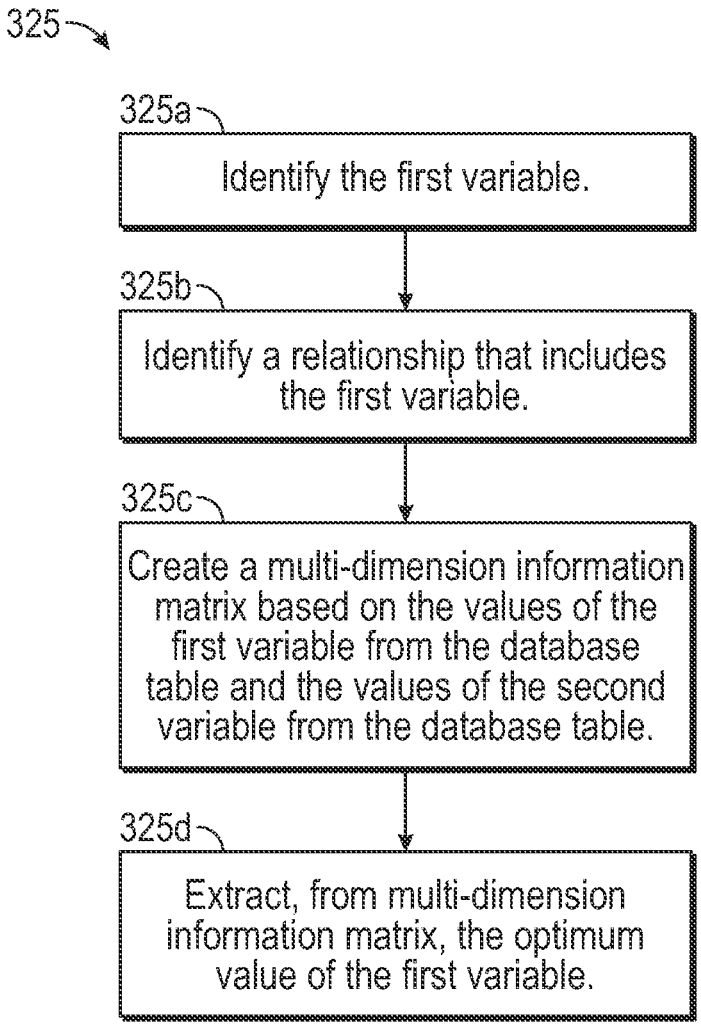
FIG. 9 is a flow chart diagram of one step of the method of FIG. 3, according to one or more aspects of the present disclosure.

In some embodiments and at the step 325, the application 205 identifies, using the database table 370, an optimum value of a first variable from the set of variables. In some embodiments and as illustrated in FIG. 9, the step 325 includes sub-steps of: identifying the first variable at step 325*a*; identifying a relationship that includes the first variable at step 325*b*; creating a multi-dimensional data matrix based on the values of the first variable from the database table 370 and the values of the second variable from the database table 370 at step 325*c*; and extracting, from multi-dimensional data matrix, the optimum value of the first variable at step 325*d*.

In some embodiments and at step 325*a*, the first variable is identified. In some embodiments, the application 205 determines that a trajectory or location of the rotary steering system is outside of a tolerance window and identifying the first variable from the set of variables is in response to the determination that the trajectory or location of the rotary steering system is outside of the tolerance window. That is, the application 205 may determine that the location and/or trajectory is outside of a tolerance window surrounding the target wellpath and that a rotary steering setting must be changed to bring the rotary steerable system back within the tolerance window. In some embodiments, a steering ratio is identified as the first variable, which can be altered to bring the location of the rotary steerable system back within the tolerance window. However, the first variable is not limited to the steering ratio and may be dog leg severity, etc. However, in other embodiments, the directional driller may identify the first variable. In other embodiments, the application 205 identifies the first variable as a variable that can be updated to better steer the rotary steerable system based on the review of the wellpath, in combination with the values in the database table 370.

In some embodiments and at step 325*b*, the application 205 identifies a relationship that includes the first variable. However, in other embodiments, the directional driller identifies the relationship that includes the variable. A relationship that includes the first variable may be identified via a database lookup, stored within the application 205, identified by the application 205 during drilling, and the like. FIG. 10 illustrates a table 375 including relationships between variables. While the table 375 lists up to three variables in one relationship, such that one relationship is associated with a first, second, and third variable, one variable may be involved in multiple relationships. For example, dog leg severity forms one relationship with steering ratio and steering ratio distance but also another relationship with formation strength and expected dog leg severity. As illustrated in the table 375, for a first relationship, the first variable is a steering ratio, the second variable is a steering ratio distance, and the third variable is a dog leg severity; for a second relationship, the first variable is an actual tool face and the second variable is a desired tool face; and for a fourth relationship, the first variable is a formation strength, the second variable is a dog leg severity, and the third variable is an expected dog leg severity.

Figure 11:
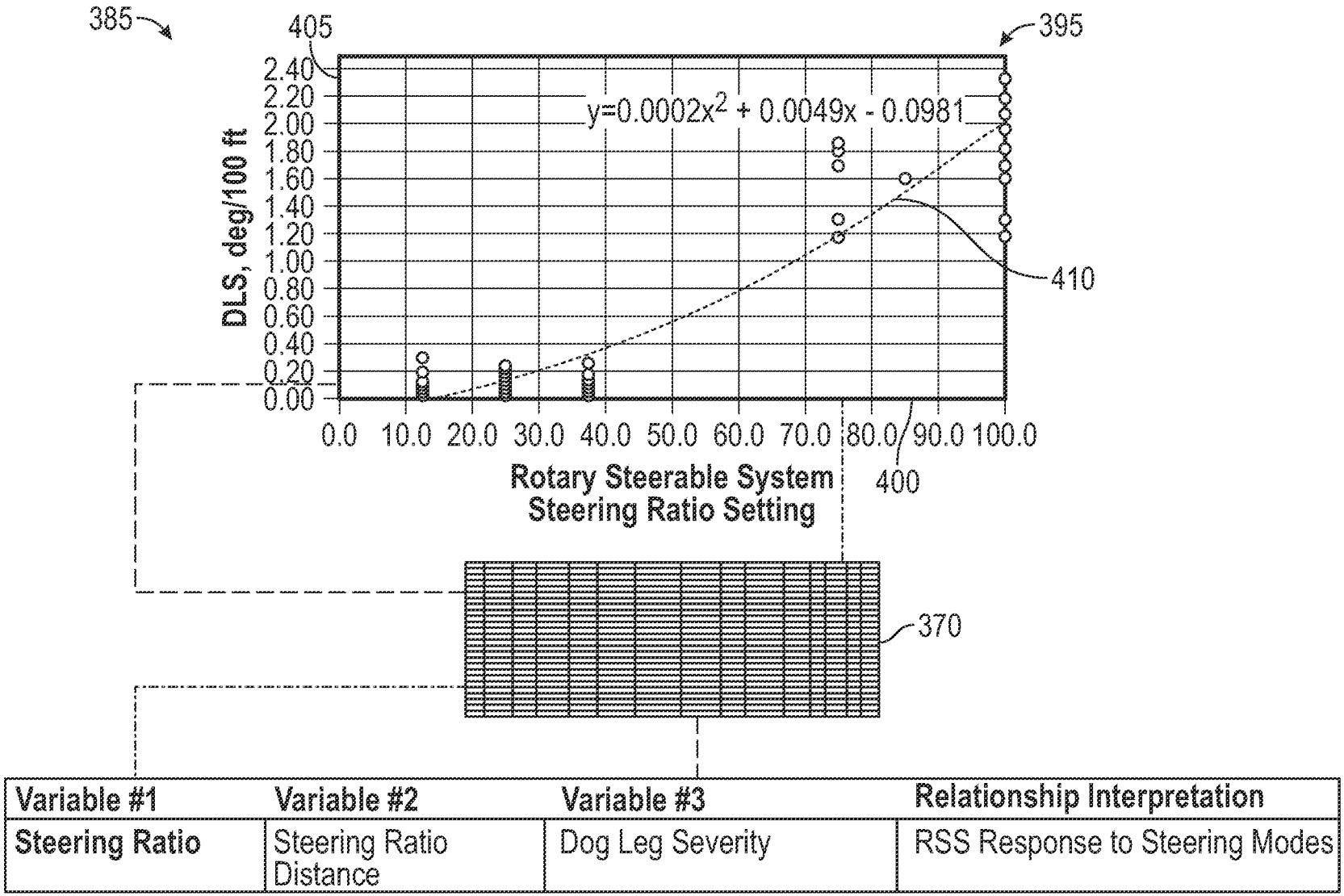
FIG. 11 is a data flow associated with the method of FIG. 3, according to one or more aspects of the present disclosure.
Figure 12:
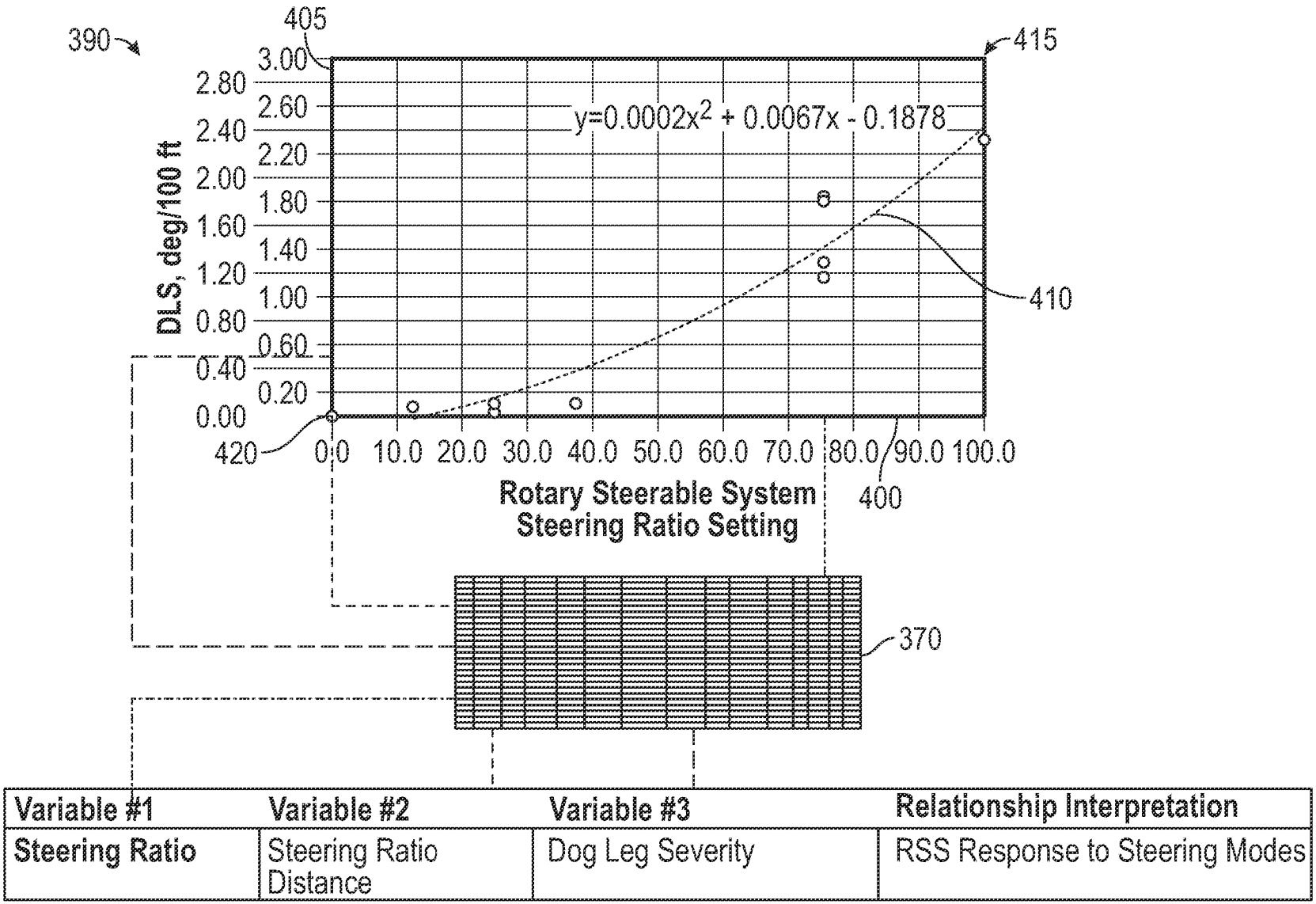
FIG. 12 is another data flow associated with the method of FIG. 3, according to one or more aspects of the present disclosure.

In some embodiments and at step 325*c*, the application 205 creates a multi-dimensional data matrix based on the values of the first variable from the database table and the values of the second variable from the database table. FIGS. 11 and 12 illustrate data flows 385 and 390, respectively, during a creation of one example of a multi-dimensional data matrix. As illustrated in FIG. 11, the first variable has been identified as a steering ratio setting, with the steering ratio setting forming a relationship with a second variable (i.e., steering ratio distance) and a third variable (i.e., dog leg severity). These three variables (e.g., steering ratio, steering ratio distance, and dog leg severity) are related due to the RSS response to steering modes. Once the steering ratio and the other two variables are identified in the relationship, the application 205 looks up the values of variables in the database table and creates a multi-dimensional matrix using those values. For example, and looking to FIG. 11, the first variable is steering ratio setting, the second variable is steering ratio distance, and the third variable is dog leg severity. The application 205 maps to the values in the database table 370 for the steering ratio (i.e., first variable) and the dog leg severity (i.e., third variable) and creates the chart 395 with one axis 400 representing values of the rotary steerable system steering ratio setting (i.e., values for the first variable) and another perpendicular axis 405 representing values of the dogleg severity in degrees per 100 ft (i.e., values for the third variable). A best-fit line 410 is illustrated on the chart 395 representing the relationship of the rotary steerable system steering ratio setting to the dogleg severity. In this example, the relationship illustrated in FIG. 11 is represented by the equation of:

$$y=0.0002x^2+0.0049x-0.0981 \quad (1)$$

As illustrated, the chart 395 is a multi-dimensional matrix having two axes. Using the multi-dimensional matrix 395 and based on the dog leg yield of 2 degrees per 100 ft, the value for the RSS steering ratio setting is approximately 100. If using the chart 395 alone to identify the optimum value of the first variable, the optimum value of the first value is 100.

However, and as illustrated in the data flow 390 of FIG. 12, the application 205 also maps to the values in the database table 370 for the steering ratio distance (i.e., the second variable). The application 205 creates a multi-dimensional matrix, illustrated by the chart 415, that is similar to the multi-dimensional matrix 395 of FIG. 11 except that another axis is added/considered. The third axis 420 represents values of steering ratio distance and is illustrated as extending out of the page. The chart 415 is a snapshot along the third axis 420 and represents a dogleg severity in degrees per 100 ft. to steering ratio setting when the steering ratio distance is from 10 ft. to 20 ft. As illustrated and when the distance from 10 ft. to 20 ft is considered, a best-fit line 425 representing the relationship of the rotary steerable system steering ratio setting to the dogleg severity is different from the best-fit line 410 of FIG. 11. In this example, the relationship illustrated in FIG. 12 is represented by the equation of:

$$y=0.0002x^2+0.0067x-0.1878 \quad (2)$$

As illustrated, the chart 415 is a multi-dimensional matrix having three axes. Using the multi-dimensional matrix 415 illustrated in FIG. 12 and based on the dog leg yield of 2 degrees per 100 ft with the distance from 10 to 20 ft., the value for the RSS steering ratio setting is approximately 90. If using the chart 415 to identify the optimum value of the first variable, the optimum value of the first value is 90.

In some embodiments, the multi-dimensional matrix considers two variables or three variables, as illustrated in FIGS. 11 and 12, respectively. However, in other embodiments, the multi-dimensional matrix considers more than three variables and has more than three axes. As another axis was added to the multi-dimensional matrix of FIG. 11 to create the multi-dimensional matrix of FIG. 12, another axis can be added to the multi-dimensional matrix of FIG. 12 to create another multi-dimensional matrix. This can continue until the value of the first variable has been refined to consider multiple variables and multiple relationships. In some embodiments, one relationship is associated a number of variables from the set of variables; and the multi-dimensional data matrix involving the relationship has a number of axes identical to the number of variables associated with the relationship.

In some embodiments and at step 325*d*, the application 205 extracts, from the multi-dimensional data matrix, the optimum value of the first variable. Generally, and as described above, the application 205 extracts the optimum value using the chart 415 and/or the best fit line 425 of the chart 415. However, a graphical representation is not required to identify the optimum value of the first variable. Instead, the equation used to depict the best-fit line may be used to extract or calculate the optimum value of the first variable.

In some embodiments and at step 330, the application 205 sends instructions to the surface control system 190 to implement the optimum value of the first variable. In some embodiments, the application 205 sends control signals to the surface control system 190 so that the surface control system 190 can then control the drive control system 210, the mud pump control system 215, and/or the drawworks control system 220 in accordance with the instructions received from the application 205.

In some embodiments and at step 335, the surface control system 190 controls, based on the optimum value of the first variable, the drive system, the mud pump system, and/or the drawworks system to change the rotary steerable setting thereby transforming a rotary steering system from a first state to a second state. In some embodiments, the surface control system 190 controls the drive system, the mud pump system, and/or the drawworks system to downlink control sequences to the RSS 178, which can cause physical changes in the arrangement of the rotary steerable system. As such, the surface control system 190 and the application 205, transform the state of the RSS 178 from a first state to a second state. The transformation may include a physical transformation or change in configuration that results in an increase or decrease in pad force, for example.

The method 300 may be altered in a variety of ways. For example, and at the creation of the database table 370 for a specific well, there is no historical information for the specific well because the drilling operation has not yet started. In this case, the application 205 may reference and create a multi-dimensional data matrix using database tables for offset wells and/or other wells that are expected to be similar to the specific well. When database tables for offset wells are used to determine an optimum value of the first variable, database tables for wells that are in close proximity to the specific well may be weighted greater than database tables for wells that are located further away.

In some embodiments, the application 205 and/or completion of at least a part of the method 300 does not require a user to manually calculate the required or optimum rotary steerable system settings. In some embodiments, the application 205 and/or completion of at least a part of the method 300 automatically correlates desired outcome with the historical rotary steerable performance of the wellbore and/or with historical rotary steerable performance of offset wells. In some embodiments, the application 205 and/or completion of at least a part of the method 300 automatically manages interpretation of the rotary steerable performance. In some embodiments, the application 205 and/or completion of at least a part of the method 300 automatically provides the rotary steerable system tool settings to achieve a desired settings or outcome. In some embodiments, the application 205 and/or completion of at least a part of the method 300 automatically assess required rotary steerable system operating conditions to steer in the right direction.

In some embodiments, the method 300 further includes the application 205 displaying, on the display 240, the optimum value of the first variable. In some embodiments, the application 205 displays the optimum value of the first variable on the display 240 and requests approval from the user of the display, such as the directional driller, to confirm the optimum value of the first variable. In other embodiments, the application 205 can display a request for the user of the display 240 for approval to control the surface control system 190 in accordance with the optimum value of the first variable.

The database table 370 may be stored on the surface control system 190 at or near the wellbore 160. However, in other embodiments, the database table 370 is stored a server remote from the wellbore 160 (e.g., "the cloud" or at a command center) and is accessed via the network.

Figure 13:
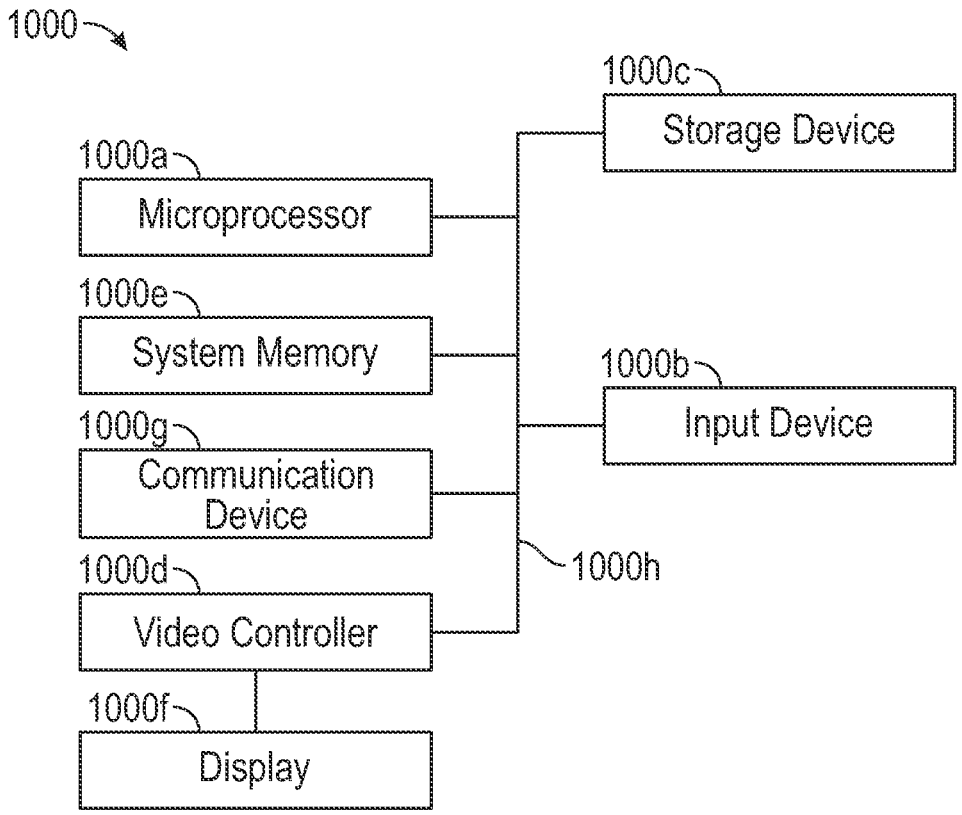
FIG. 13 is a diagrammatic illustration of a node for implementing one or more example embodiments of the present disclosure, according to an example embodiment.

In an example embodiment, as illustrated in FIG. 13 with continuing reference to FIGS. 1-12, an illustrative node 1000 for implementing one or more of the example embodiments described above and/or illustrated in FIGS. 1-12 is depicted. The illustrative node 1000 includes a microprocessor 1000*a*, an input device 1000*b*, a storage device

1000*c*, a video surface control system 1000*d*, a system memory 1000*e*, a display 1000*f*, and a communication device 1000*g* all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, smartphones and cell phones.

In several example embodiments, one or more of the components of the systems described above and/or illustrated in FIGS. 1-12 include at least the illustrative node 1000 and/or components thereof, and/or one or more nodes that are substantially similar to the illustrative node 1000 and/or components thereof. In several example embodiments, one or more of the above-described components of the illustrative node 1000, the system 10, and/or the example embodiments described above and/or illustrated in FIGS. 1-12 include respective pluralities of same components.

In several example embodiments, one or more of the applications, systems, and application programs described above and/or illustrated in FIGS. 1-13 include a computer program that includes a plurality of instructions, data, and/or any combination thereof; an application written in, for example, Arena, Hypertext Markup Language (HTML), Cascading Style Sheets (CSS), JavaScript, Extensible Markup Language (XML), asynchronous JavaScript and XML (Ajax), and/or any combination thereof; a web-based application written in, for example, Java or Adobe Flex, which in several example embodiments pulls real-time information from one or more servers, automatically refreshing with latest information at a predetermined time increment; or any combination thereof.

In several example embodiments, a computer system typically includes at least hardware capable of executing machine readable instructions, as well as the software for executing acts (typically machine-readable instructions) that produce a desired result. In several example embodiments, a computer system may include hybrids of hardware and software, as well as computer sub-systems.

In several example embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several example embodiments, hardware may include any physical device that is capable of storing machine-readable instructions, such as memory or other data storage devices. In several example embodiments, other forms of hardware include hardware sub-systems, including transfer devices such as modems, modem cards, ports, and port cards, for example.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server.

In several example embodiments, combinations of software and hardware could also be used for providing enhanced functionality and performance for certain embodiments of the present disclosure. In an example embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several example embodiments, computer readable mediums include, for example, passive data storage, such as a random-access memory (RAM) as well as semi-permanent data storage such as a compact disk read only memory (CD-ROM). One or more example embodiments of the present disclosure may be embodied in the RAM of a computer to transform a standard computer into a new specific computing machine. In several example embodiments, data structures are defined organizations of data that may enable an embodiment of the present disclosure. In an example embodiment, a data structure may provide an organization of data, or an organization of executable code.

In several example embodiments, any networks and/or one or more portions thereof may be designed to work on any specific architecture. In an example embodiment, one or more portions of any networks may be executed on a single computer, local area networks, client-server networks, wide area networks, internets, hand-held and other portable and wireless devices and networks.

In several example embodiments, a database may be any standard or proprietary database software. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, a plurality of instructions stored on a non-transitory computer readable medium may be executed by one or more processors to cause the one or more processors to carry out or implement in whole or in part the above-described operation of each of the above-described example embodiments of the system, the method, and/or any combination thereof. In several example embodiments, such a processor may include one or more of the microprocessor 1000*a*, any processor(s) that are part of the components of the system, and/or any combination thereof, and such a computer readable medium may be distributed among one or more components of the system. In several example embodiments, such a processor may execute the plurality of instructions in connection with a virtual computer system. In several example embodiments, such a plurality of instructions may communicate directly with the one or more processors, and/or may interact with one or more operating systems, middleware, firmware, other applications, and/or any combination thereof, to cause the one or more processors to execute the instructions.

In several example embodiments, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several example embodiments, while different steps, processes, and procedures are described as appearing as distinct acts, one or more of the steps, one or more of the processes, and/or one or more of the procedures may also be performed in different orders, simultaneously, and/or sequentially. In several example embodiments, the steps, processes and/or procedures may be merged into one or more steps, processes, and/or procedures.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations and this is within the contemplated scope of disclosure herein, unless stated otherwise.

The phrase "at least one of A and B" should be understood to mean "A, B, or both A and B." The phrases "one or more of the following: A, B, and C" and "one or more of A, B, and C" should each be understood to mean "A, B, or C; A and B, B and C, or A and C; or all three of A, B, and C."

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Although several example embodiments have been described in detail above, the embodiments described are example only and are not limiting, and those of ordinary skill in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A method of steering, using a surface control system and an electronic application, a rotary steerable system ("RSS") comprising arms configured to move between a first configuration and a second configuration, the method comprising:

identifying, during a rotary steerable drilling operation and by the electronic application, an ending of a first drilling segment and a simultaneous beginning of a second drilling segment that follows directly after the first drilling segment;

wherein identifying the ending of the first drilling segment and the simultaneous beginning of the second drilling segment comprises any one or more the following:

identifying, by the electronic application, a change in a rotary steerable setting;

initiating a standard survey; and identifying, by the electronic application, a change in surface or downhole parameters;

identifying, by the electronic application, a data set of the first drilling segment;

wherein the data set comprises values of variables; and wherein relationships are identified between variables;

accessing, by the electronic application, a database table that stores a data set for each drilling segment;

wherein the database table comprises a plurality of rows;

wherein each row stores values of a set of variables; and wherein each row is associated with a single drilling segment;

automatically creating, by the electronic application and in response to the identification of the first drilling segment ending, a new row in the database table to store the variable values of the first drilling segment;

identifying, using the database table and the electronic application, an optimum value of a first variable from the set of variables;

wherein the optimum value of the first variable from the set of variables is for an upcoming drilling segment; and wherein identifying the optimum value of the first variable from the set of variables comprises:

identifying a relationship that includes the first variable;

wherein the relationship is associated with the first variable, a second variable from the set of variables, and a third variable from the set of variables;

creating a multi-dimensional data matrix based on the values of the first variable from the database table, the values of the second variable from the database table, and the values of the third variable from the database table; and extracting, from the multi-dimensional data matrix, the optimum value of the first variable; and sending, by the electronic application and to the surface control system, a set of instructions to implement the optimum value of the first variable; and controlling, by the surface control system, a mud pump system and/or a drive system using the set of instructions to cause the arms to move from the first configuration to the second configuration.

2. The method of claim 1, wherein the first variable is a steering ratio, the second variable is a steering ratio distance, and the third variable is a dog leg severity.

3. The method of claim 1, wherein the first variable is an actual tool face and the second variable is a desired tool face.

4. The method of claim 1, wherein the first variable is a formation strength, the second variable is a dog leg severity, and the third variable is an expected dog leg severity.

5. A method of steering, using a surface control system and an electronic application, a rotary steerable system ("RSS") comprising arms configured to move between a first configuration and a second configuration, the method comprising:

identifying, during a rotary steerable drilling operation and by the electronic application, an ending of a first drilling segment and a simultaneous beginning of a second drilling segment that follows directly after the first drilling segment;

wherein identifying the ending of the first drilling segment and the simultaneous beginning of the second drilling segment comprises any one or more the following:

identifying, by the electronic application, a change in a rotary steerable setting;

initiating a standard survey; and identifying, by the electronic application, a change in surface or downhole parameters;

identifying, by the electronic application, a data set of the first drilling segment;

wherein the data set comprises values of variables; and wherein relationships are identified between variables;

accessing, by the electronic application, a database table that stores a data set for each drilling segment;

wherein the database table comprises a plurality of rows;

wherein each row stores values of a set of variables; and wherein each row is associated with a single drilling segment;

automatically creating, by the electronic application and in response to the identification of the first drilling segment ending, a new row in the database table to store the variable values of the first drilling segment;

identifying, using the database table and the electronic application, an optimum value of a first variable from the set of variables;

wherein the optimum value of the first variable from the set of variables is for an upcoming drilling segment; and wherein identifying the optimum value of the first variable from the set of variables comprises:

identifying a relationship that includes the first variable;

wherein the relationship is associated with the first variable and a second variable from the set of variables;

creating a multi-dimensional data matrix based on the values of the first variable from the database table and the values of the second variable from the database table; and extracting, from multi-dimensional data matrix, the optimum value of the first variable;

wherein the relationship is associated with a number of variables from the set of variables; and wherein the multi-dimensional data matrix has a number of axes identical to the number of variables associated with the relationship; and sending, by the electronic application and to the surface control system, a set of instructions to implement the optimum value of the first variable; and controlling, by the surface control system, a mud pump system and/or a drive system using the set of instructions to cause the arms to move from the first configuration to the second configuration.

6. The method of claim 5, wherein the first variable is a rotary steerable setting.

7. The method of claim 5, further comprising determining that a trajectory or location of the rotary steering system is outside of a tolerance window;

wherein identifying, using the database table and the electronic application, the optimum value of the first variable from the set of variables is in response to the determination that the trajectory or location of the rotary steering system is outside of the tolerance window.

8. An apparatus for steering, using a surface control system and an electronic application, a rotary steerable system ("RSS") comprising arms configured to move between a first configuration and a second configuration, the apparatus comprising:

the surface control system of a drilling rig; wherein the surface control system of the drilling rig comprises a mud pump system and/or a drive system; and the electronic application, wherein the electronic application is configured to:

identify, during a rotary steerable drilling operation, an ending of a first drilling segment and a simultaneous beginning of a second drilling segment that follows directly after the first drilling segment;

wherein identifying the ending of the first drilling segment and the simultaneous beginning of the second drilling segment comprises any one the following:

identifying a change in a rotary steerable setting;

initiating a standard survey; and identifying a change in surface or downhole parameters;

identify a data set of the first drilling segment;

wherein the data set comprises values of variables; and wherein relationships are identified between variables;

access a database table that stores a data set for each drilling segment;

wherein the database table comprises a plurality of rows;

wherein each row stores values of a set of variables; and wherein each row is associated with a single drilling segment;

automatically create, in response to the identification of the first drilling segment ending, a new row in the database table to store the variable values of the first drilling segment;

identify, using the database table, an optimum value of a first variable from the set of variables;

wherein the optimum value of the first variable from the set of variables is for an upcoming drilling segment; and wherein identifying the optimum value of the first variable from the set of variables comprises:

identifying a relationship that includes the first variable;

wherein the relationship is associated with the first variable, a second variable from the set of variables, and a third variable from the set of variables;

creating a multi-dimensional data matrix based on the values of the first variable from the database table, the values of the second variable from the database table, and the values of the third variable from the database table; and extract, from multi-dimensional data matrix, the optimum value of the first variable;

and send, to the surface control system, a set of instructions to implement the optimum value of the first variable; and wherein the surface control system is configured to control the mud pump system and/or the drive system using the set of instructions to cause the arms to move from the first configuration to the second configuration.

9. The apparatus of claim 8, wherein the first variable is a steering ratio, the second variable is a steering ratio distance, and the third variable is a dog leg severity.

10. The apparatus of claim 8, wherein the first variable is an actual tool face and the second variable is a desired tool face.

11. The apparatus of claim 8, wherein the first variable is a formation strength, the second variable is a dog leg severity, and the third variable is an expected dog leg severity.

12. An apparatus for steering, using a surface control system and an electronic application, a rotary steerable system ("RSS") having arms configured to move between a first configuration and a second configuration, the apparatus comprising:

the surface control system of a drilling rig; wherein the surface control system of the drilling rig comprises a mud pump system and/or a drive system; and the electronic application, wherein the electronic application is configured to:

identify, during a rotary steerable drilling operation, an ending of a first drilling segment and a simultaneous beginning of a second drilling segment that follows directly after the first drilling segment;

wherein identifying the ending of the first drilling segment and the simultaneous beginning of the second drilling segment comprises any one the following:

identifying a change in a rotary steerable setting;

initiating a standard survey; and identifying a change in surface or downhole parameters;

identify a data set of the first drilling segment;

wherein the data set comprises values of variables; and wherein relationships are identified between variables;

access a database table that stores a data set for each drilling segment;

wherein the database table comprises a plurality of rows;

wherein each row stores values of a set of variables; and wherein each row is associated with a single drilling segment;

automatically create, in response to the identification of the first drilling segment ending, a new row in the database table to store the variable values of the first drilling segment;

identify, using the database table, an optimum value of a first variable from the set of variables;

wherein the optimum value of the first variable from the set of variables is for an upcoming drilling segment; and wherein identifying the optimum value of the first variable from the set of variables comprises:

identifying a relationship that includes the first variable;

wherein the relationship is associated with the first variable, and a second variable from the set of variables;

wherein the relationship is associated with a number of variables from the set of variables;

wherein a multi-dimensional data matrix has a number of axes identical to the number of variables associated with the relationship; and creating the multi-dimensional data matrix based on the values of the first variable from the database table, and the values of the second variable from the database table; and extract, from the multi-dimensional data matrix, the optimum value of the first variable;

and send, to the surface control system, a set of instructions to implement the optimum value of the first variable; and wherein the surface control system is configured to control the mud pump system and/or the drive system using the set of instructions to cause the arms to move from the first configuration to the second configuration.

13. The apparatus of claim 12, wherein the first variable is a rotary steerable setting.

14. The drilling apparatus of claim 12, wherein the electronic application is further configured to determine that a trajectory or location of the rotary steering system is outside of a tolerance window;

wherein identifying, using the database table and the electronic application, the optimum value of the first variable from the set of variables is in response to the determination that the trajectory or location of the rotary steering system is outside of the tolerance window.

* * * * *